United States Patent [19]

Schirneker

[11] Patent Number: 4,655,140

[45] Date of Patent: Apr. 7, 1987

[54] PROJECTILE, FOR EXAMPLE FOR HUNTING PURPOSES, AND PROCESS FOR ITS MANUFACTURE

[76] Inventor: Hans-Ludwig Schirneker, Engelslit 10, Möhnesse-Völlinghausen, Fed. Rep. of Germany

[21] Appl. No.: 724,467

[22] Filed: Apr. 18, 1985

Related U.S. Application Data

[63] Continuation of Ser. No. 424,359, Sep. 27, 1982, abandoned, which is a continuation of Ser. No. 128,157, Mar. 7, 1980, abandoned.

[30] Foreign Application Priority Data

Mar. 10, 1979 [DE] Fed. Rep. of Germany ..... 2909471
Mar. 31, 1979 [DE] Fed. Rep. of Germany ..... 2912910

[51] Int. Cl.[4] ..... F42B 11/10

[52] U.S. Cl. ..... 102/508; 102/516; 102/517

[58] Field of Search ..... 102/501-503, 102/507-516, 526, 529

[56] References Cited

U.S. PATENT DOCUMENTS

| | | | |
|---|---|---|---|
| 53,582 | 4/1866 | De Coursey . | |
| 189,043 | 4/1877 | Kennedy . | |
| 843,017 | 2/1907 | Hoxie . | |
| 871,825 | 11/1907 | Schupmann . | |
| 1,023,469 | 4/1912 | Haslett . | |
| 1,134,797 | 4/1915 | Wood . | |
| 2,123,981 | 7/1938 | Whipple . | |
| 3,003,420 | 10/1963 | Nosler . | |
| 3,049,828 | 8/1962 | Mills . | |
| 3,138,102 | 6/1964 | Meyer et al. | 102/509 |
| 3,349,711 | 10/1967 | Darigo et al. . | |
| 3,442,216 | 5/1969 | Six et al. . | |
| 3,476,049 | 11/1969 | Gawlick et al. . | |
| 4,044,685 | 8/1977 | Avcin . | |
| 4,136,616 | 1/1979 | Schirneker . | |

FOREIGN PATENT DOCUMENTS

| | | | |
|---|---|---|---|
| 2286364 | 4/1976 | France | 102/529 |
| 4971 | of 1897 | United Kingdom . | |

*Primary Examiner*—Harold J. Tudor
*Attorney, Agent, or Firm*—Schwartz, Jeffery, Schwaab, Mack, Blumenthal & Evans

[57] ABSTRACT

A projectile suitable for example for hunting purposes, with a body tapering toward its forward end, comprising in the area of its tapered forward end a plurality of weakened locations in the form of cuts and/or notches extending at an angle obliquely to its longitudinal axis. The cuts or notches offer resistance to the rotation of the projectile in flight, so that the rotation of the projectile will be braked in flight, and projectile will drop rapidly after passing through the range of the target desired. Upon impact on a target, however, the rotation of the projectile, reduced while in flight, is appreciably enhanced and a cleaner entry and passage of the projectile is attained.

14 Claims, 16 Drawing Figures

PROJECTILE, FOR EXAMPLE FOR HUNTING PURPOSES, AND PROCESS FOR ITS MANUFACTURE

CROSS-REFERENCE TO RELATED APPLICATION

This is a continuation of application Ser. No. 424,359, filed Sept. 27, 1982, now abandoned, which is in turn a continuation application of Ser. No. 128,157, filed Mar. 7, 1980, now abandoned.

The invention concerns a projectile primarily intended for hunting purposes, with a body of the projectile tapering toward its front end and containing in certain embodiments a central opening originating in the front end and being closed to the outside. The invention further contains a process for the manufacture of such projectiles.

When impacting a relatively soft target, for example the flesh of the body of a game animal, such projectiles are expected to split apart in the shape of a mushroom, so that its kinetic energy is dissipated rapidly, while producing a shock effect leading to the stunning or even death of the animal, even if the wound itself is not lethal Conversely, upon impact on a harder target, for example the bone of a game animal, the projectiles are to produce a through passage that is as clean as possible.

An example of projectiles of this type is the hunting projectile known from DE-PS No. 22 28 733 and containing a lead filling, which upon impact on the body of a game animal enhances the spreading of the wall surrounding the body of the projectile and prevents the explosive bursting of the projectile, so that the forward end of the projectile tilts over outwardly without tearing. Even though projectiles of this type mushroom with some regularity and produce clean passages, they present the disadvantage that the lead filling is comminuted and ground into exceedingly fine particles, which in turn are distributed around the path of the projectile and potentially may cause poisoning. The lead particles are fine enough so that they cannot be seen by the unaided eye and are therefore difficult to remove during the preparation of the meat as food. Because of the large surface area of the finely ground lead (lead slime), the consumption of game penetrated by the lead causes nausea and even poisoning. A further disadvantage is the fact that even though such projectiles rapidly lose their kinetic energy in the target, they are capable of flying very far when they meet no target, so that they represent a substantial danger behind the target. This is of particular importance in inhabitated areas and wherever hunting grounds are adjacent to settlements.

It is the object of the invention to provide a projectile suitable for example for the purpose of hunting, which exhibits stable behavior in flight within a certain range, but rapidly loses its ability to fly beyond this range thus posing no danger to areas past said range, and which furthermore produces a smooth and clean path through the body of a game animal without poisoning it.

The object is attained according to the invention with a projectile of the abovementioned type in that the body of the projectile comprises, at least partially in the area of its tapered forward end, a plurality of weakened locations in the form of recesses and/or notches inclined at an angle to the longitudinal axis of the projectile and originating at its outer side, said recesses or notches presenting a wall offering resistance to the rotation of the projectile in flight.

The recesses lead to the mushrooming of the projectile in the target, while no parts of it are being torn off, while the oblique notches provided on the external side of the projectile, which may form part of said recesses, divert the air flowing over the body of the projectile, thus applying a braking effect to the rotation of the projectile in flight. Initially, this braking effect is scarcely noticeable, but becomes appreciable after the projectile has passed its normal range, which in the case of hunting projectiles is for example between 300 and 400 meters. The braking effect of the notches then rapidly leads to instability of the projectile in flight, which subsequently soon drops to the ground.

The closing piece, for example an insert placed into the central opening, has a conical configuration and a cup-like impression on its forward side. This cup-like depression produces increased resistance during penetration into the body of the game animal and thus a more rapid penetration, because the insert enters the opening at a higher speed, consequently accelerating the mushrooming of the projectile body in the target.

The notches are preferably inclined in a direction opposite to the direction of rotating of the projectile, in order to hinder the rotation of the projectile in flight, while accelerating it in the target, thus producing clean projectile passages.

According to another form of embodiment of the invention, at the forward end of the projectile body two or more bosses are provided, with their front surfaces at a steep angle to the longitudinal axis of the projectile and opposed to the rotational direction of the projectile, while they may be bevelled off to one side in the manner of a propeller. In this case, the forward end of the projectile is appropriately equipped with a closing piece in the form of a releasable bonnet, carrying recesses on its rear edge, to fit the bosses on the front end of the body of the projectile. The bonnet preferably is released immediately following the firing of the projectile in the barrel of the weapon, so that the bosses act against the rotation of the projectile in flight but increase the rotation upon penetration into the target. In order to insure the safe release of the bonnet, it extends to the cylindrical part of the projectile.

The bonnet may consist, for example, of a synthetic material and may contain in its center a pin inserted in a center opening of the body of the projectile, in order to secure the bonnet to the projectile body.

In the center opening, under the insert, a filler consisting of a substance that is not harmful to health, for example based on a protein, cellulose or starch, may be placed; the filler may for example be in the form of pressed briquet. The filler facilitates the mushrooming of the projectile in the target, but leaves no residues in the body of the animal that may be harmful to health when consumed. Mushrooming in the target takes place in the target in a manner that enhances the rotation imparted to the projectile by the rifling of the weapon, by virtue of the division of the forward part of the body of the projectile into strips, which bend outwardly and roll up at least in part, and are positioned to a certain degree obliquely to the longitudinal axis of the projectile. This rotation enhancing mushrooming leads to an especially favorable and clean passage, so that an impacted bone may be penetrated with minimum splintering.

When the filler is a pressed body, it may contain small voids so that it may be initially compressed to a slight extent upon impacting the target, with the mushrooming process beginning only following the penetration of some of the material of the target into the center opening of the projectile body and the pushing of the insert deeper into the opening.

The projectile according to the invention is suitable primarily for hunting purposes, but may be used for other purposes or in other weapons. It may thus be used in hunting rifles, other types of rifles, also revolvers or pistols, with the external dimensions of the projectile being adapted to the caliber and type of each weapon.

According to still another characteristic of the invention, the projectile is made of a cylindrical blank of copper, red brass or iron, by means of initially pressing an inwardly tapering hole into the front end of the blank, followed by the forming from the outside or the inside, recesses or notches into the wall surrounding the hole to act as weakened locations, and by the pressing of the end perforated in this manner into a point with an essentially cylindrical or conical center hole expanded at its outer end. Subsequently, the filler and/or the insert is placed into the center hole. The projectile is then finished. The projectile according to the invention may thus be produced by means of simple pressing, so that no expensive milling work, which can be performed at a justifiable cost or turret lathes only, is required.

The recesses acting as weakened locations preferably consist of cuts with walls adjacent to and in contact with each other, so that the projectile has a closed external configuration even when the cuts are applied from the outside to the body of the projectile.

The fundamental concept of the invention is to brake the rotation of the projectile in flight in order to prevent the uncontrolled flight of the projectile past the range desired and further to insure effective passage into an impacted body without poisoning or splintering bones. During the penetration of the body into a target, rotation around the longitudinal axis of the projectile—intentionally reduced in flight—is relatively increased, thus preventing the tumbling of the projectile.

The relatively increased rotation results in a cleaner, but larger exit wound that produces increased bleeding by the animal. The insert in the projectile body leads to accelerated reaction of the target.

Examples of embodiment of the projectile according to the invention are shown in the drawing at a greatly enlarged scale, wherein FIG. 1 shows a longitudinal section through a first form of embodiment of the projectile;

Figure 1:
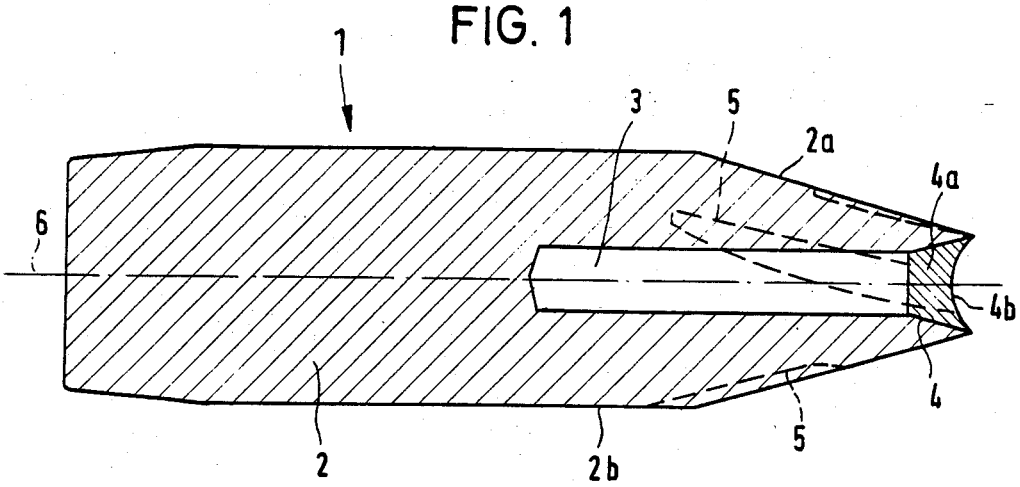

The projectile 1 shown in FIG. 1 has a solid body 2, for example of red brass or copper. A blind hole 3 is provided in its tapering forward end, said hole being essentially cylindrical, terminating at its forward end in a conical expansion 4. In the area of the blind hole 3, notches 5 are formed on the exterior of the projectile with an angular inclination to the longitudinal axis 6, in the vicinity of the point 2*a*, said notches extending rearwardly to the cylindrical center part 2*b* of the body of the projectile and ending there. The notches are arranged so that they oppose the rotation imparted to the projectile in flight by the rifling of the weapon by means of the air flowing through them, which is the reason why they run in a direction opposite to the direction of rotation. Although it appears that the notches are not uniform in length or depth in FIG. 1, the showing therein is intended to represent the notches as they actually appear, due to the oblique direction thereof.

A disk shaped insert 4*a* is arranged in the conical expansion 4 of the blind hole 3, which has the shape of a truncated cone corresponding with the conical expansion 4. A cup like depression 4*b* is provided on the front side of the insert 4*a*, facilitating the penetration of material of the target impacted and the formation of the insert 4*a* into the blind hole 3.

Figure 2:
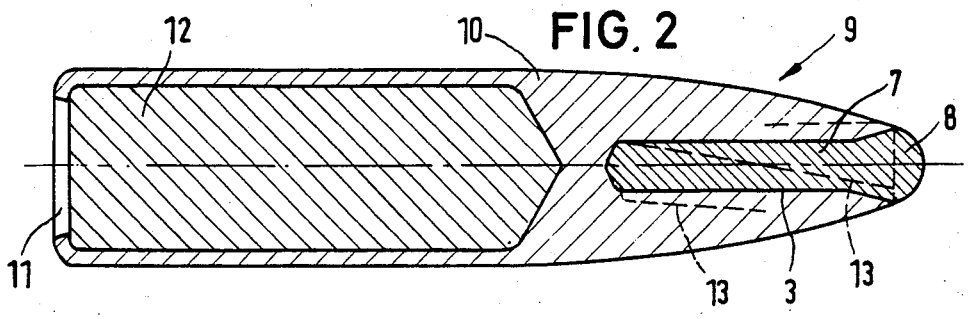
FIG. 2 is a longitudinal section through a second form of embodiment of the projectile, containing in its rear area a lead filler.

The projectile 9 shown in FIG. 2 has a projectile body 10, comprising a recess 11 in its rear area, filled with lead 12. The body of the projectile may consist of iron or steel. An insert 7 with a convex tip 8 is positioned in the hole 3. If the notches are formed in the outside surface of the projectile and do not extend fully to the hole 3, some mushrooming will nevertheless occur. Oblique cuts 13 are further provided in the body of the projectile 10 in the vicinity of the blind hole 3, serving as weakened locations and facilitating the mushrooming of the body of the projectile in the target. The cuts 13 may extend both from the blind hole 3 outwardly, or inwardly from the outside, or may even be continuous from the outside into the blind hole, so that the cuts also comprise counter-rotative notches. Conversely, they may be invisible on the surface so as not to interfere with rotation, in which event notches 5 would be provided. Although cuts 13 may not appear identical in length or depth, they are similarly shown as they would appear, taking into account the oblique formation thereof as shown by the centralmost cut 13.

The projectile of FIG. 2 mushrooms in the target so that the lead filling 12 is not exposed, thus preventing the poisoning of the target by the lead. This will be hereinafter described when specific reference is made to FIGS. 4 and 5.

Figure 3:
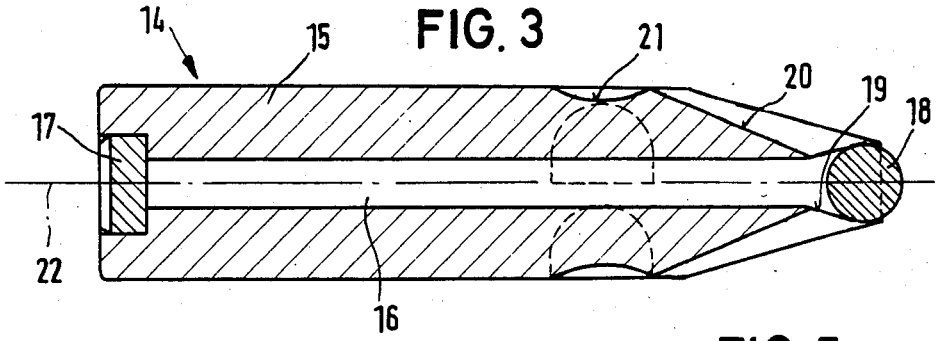
FIG. 3 is a longitudinal section through a third form of embodiment of the projectile with a continuous center opening.

The projectile 14 shown in FIG. 3 has a body 15 with a continuous center hole 16, closed at the rear end by an inserted platelet 17 and at the front end with an inserted ball 18. The ball 18 consists of a material of reduced strength and may be compressed to a certain degree, so that it may be pressed from the conical expansion 19 of the hole 16 into the latter and then through the hole, in order to finally displace the platelet 17 from the body 15 of the projectile. Cuts 20 are applied to the body 15 from the outside, and as shown extend to the recesses 21 in the cylindrical part of the body 15 of the projectile. For simplicity of illustration, both cuts appear in the same plane, although the cuts are obliquely directed opposite to the direction of rotation of the projectile in flight. In this manner, the strips of the projectile body between cuts 20 are bent outward during the mushrooming of the projectile. This is true to a lesser extent even when the cuts 20 extend in the direction of the longitudinal axis 22 of the body 15 of the projectile. The notches 21 are additionally provided, and are directed counter-rotative to the direction of rotation of the projectile. As above noted, cuts 20 and notches 21 can be combined to perform the dual function noted.

Figure 4:
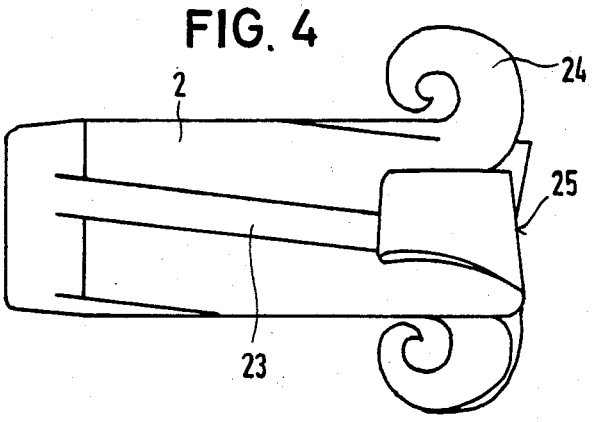
FIG. 4 is a side elevation of the projectile of FIG. 2 after mushrooming upon impact on a target.
Figure 5:
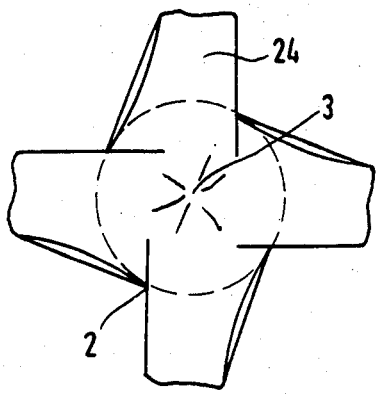
FIG. 5 is a front view of the mushrooming projectile of FIG. 4.
Figure 6:
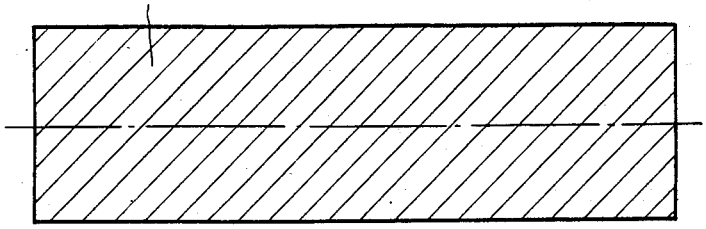
FIG. 6 is a longitudinal section through a cylindrical blank from which a projectile of the type shown in FIG. 2 is made.
Figure 7:
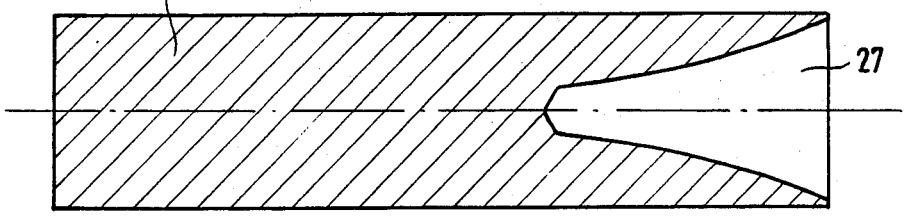
FIG. 7 is a longitudinal section through the blank of FIG. 6, following the formation of an opening in its forward end.

FIGS. 4 and 5 show the mushrooming of the projectile in the target according to FIG. 2. The projectile according to FIG. 3 exhibits similar behavior in the target.

In FIG. 4, grooves 23 may be seen in the body 2 of the projectile; they are impressed by the rifling of the weapon during the firing of the projectile. Four strips 24 (between cuts 13) have been formed at the forward end of the body of the projectile; they are bent over outwardly and slightly rolled, so as to form oblique front edges 25. The reason for this is that in the rolling back of strips 24, they are in a plane between oblique cuts 13, whereby the fully rolled back front surface 25 is likewise in a plane offset from a plane perpendicular to the axis of the projectile. As a result, rotation of the projectile in the target is enhanced relative to strips formed from longitudinal cuts, which would present essentially flat surfaces perpendicular to the axis of the projectile and present more resistance to rotation and travel of the projectile in the target. By providing oblique or angled edges 25, the target material is deflected off such edges so that rotation is less inhibited. This is of course an important feature of the invention.

Figure 9:
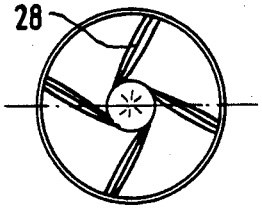
FIG. 9 is a view of the forward end of the blank of FIG. 8 with the opening.
Figure 8:
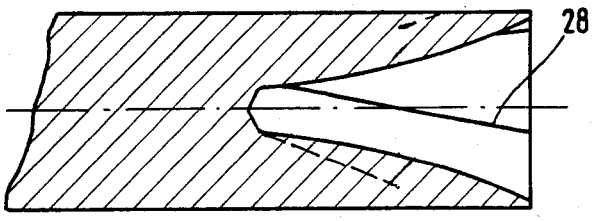
FIG. 8 is a longitudinal section through the front end of the blank, following the formation of grooves in the area of the hole from the inside.
Figure 10:
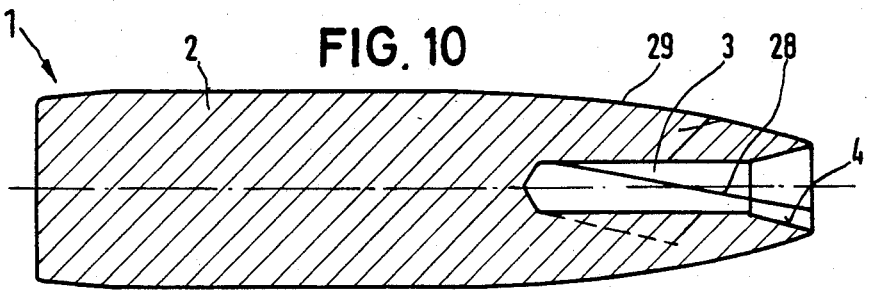
FIG. 10 is a longitudinal section through an already-shaped projectile body prior to the insertion of a filler-/and or an insert into its center opening.

FIGS. 6 to 10 demonstrate how a projectile of the type shown in FIG. 2 may be produced by means of a pressing apparatus. The initial material consists of a cylindrical blank 26, which may be cut, for example, from a rod or a wire. According to FIG. 7, an outwardly expanding hole 27 has been impressed into the front end of the blank 26 by means of a mandrel, which increases the length of the blank 26. According to FIGS. 8 and 9, grooves 28 are applied to the wall of the hole 27 and extend to the surface of the projectile, with their flanks, as shown in FIG. 9, at a distance from each other. Subsequently, the forward end of the blank is pressed together so as to form the point 29 seen in FIG. 10, wherein an essentially cylindrical blind hole 3 with a conically expanded end 4 is located. The grooves 28 are now compressed so that their flanks are in direct contact with each other, thus forming weakened locations, recognizable in practice merely as hairline cracks. It is now only necessary to insert the filler and/or the insert, or a bonnet into the blind hole to complete the projectile. As in FIG. 2, the cuts are shown in FIGS. 8 and 10 as they would appear in the section, with the varying lengths being due to the oblique direction of the cuts.

The projectile may thus be produced by means of simple pressing and piercing methods without the need for expensive milling operations, on conventional machines. If the projectile is to include a lead filler, as shown in FIG. 2, a suitable blank must be used.

Figure 11:
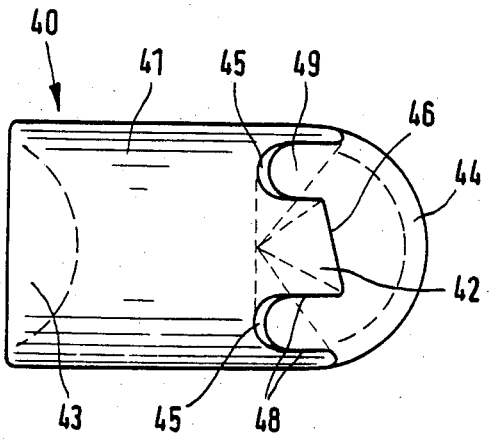
FIG. 11 is a side elevation of a fifth embodiment of the projectile with protruding bosses on the forward end of the body of the projectile.
Figure 12:
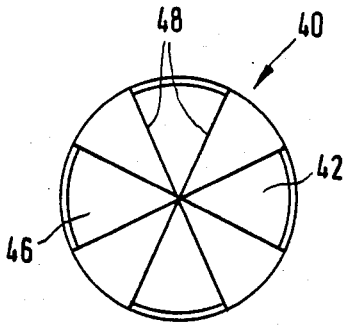
FIG. 12 is a front view of the projectile body of FIG. 11 with the bonnet removed.

The projectile 40 shown in FIGS. 11 and 12 contains at the forward end of the body 41 of the projectile cuts 48 parallel to each other, with bosses 42 having oblique front surfaces 46 being formed between said cuts 48. A bonnet 44 is provided with projections 49 fitting between the flanks of the bosses 42, so that the bonnet 44 is secured in this manner. The projections 49 are, as seen in FIG. 11, somewhat shorter than the cuts, so that openings 45 are formed, which may be entered during the firing of the projectile by propulsion gases capable of separating the bonnet 44 from the body 41 of the projectile even in the barrel of the weapon. A spherical depression 43 is provided in the bottom of the body 41 of the projectile.

Figure 13:
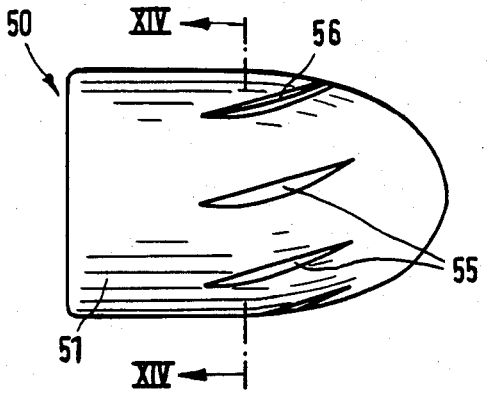
FIG. 13 is a side elevation of a projectile intended for pistols or revolvers, with the notches hindering rotation being visible.
Figure 14:
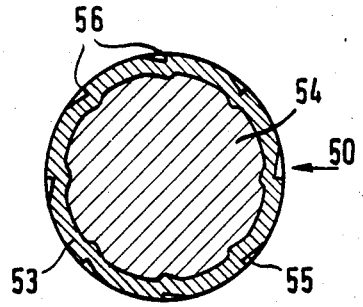
FIG. 14 is a cross section through the projectile of FIG. 13 taken on the line XIV—XIV.

The projectile represented in FIGS. 13 and 14 is intended for pistols and revolvers and has a body 51 of the projectile with a steel jacket 53 and a lead core 54. In the forward part of the body 51 of the projectile, a plurality of notches 55 is impressed into the steel jacket 13. The notches are located obliquely with respect to the longitudinal axis of the projectile, are saw tooth-like in cross section and extend opposite to the direction of rotation of the projectile in flight, in the forward area of the body 51 of the projectile. The rear or trailing wall 56 of each notch 55 is positioned practically radially with respect to the body 51 of the projectile and thus forms a guide surface impacted by the flow of air, thus hindering the rotation of the projectile 50 while in flight.

Figure 15:
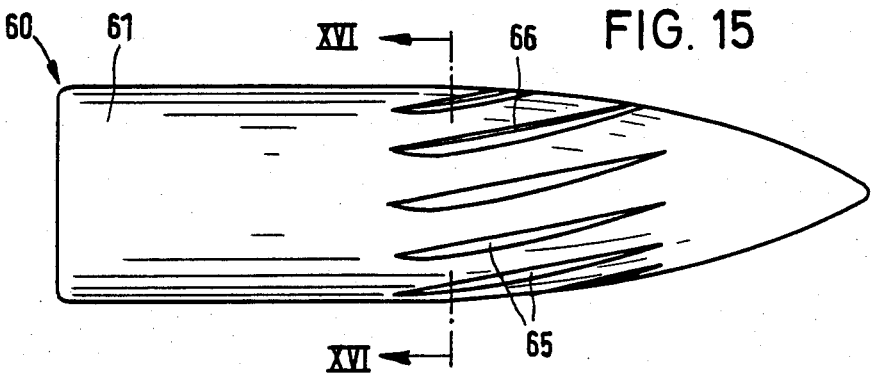
FIG. 15 is a side elevation of a projectile intended for rifles, wherein on the forward end the notches hindering rotation are again visible.
Figure 16:
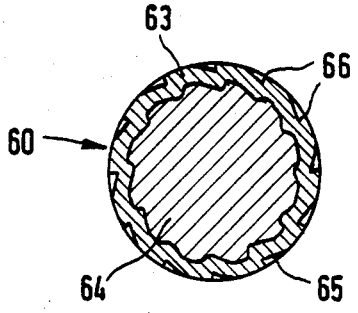
FIG. 16 is a cross section of the projectile of FIG. 15 taken on the line XVI—XVI.

The projectile 60 shown in FIGS. 15 and 16 is intended for rifles, but is of a configuration similar to the projectile of FIGS. 13 and 14. Here again the body 61 of the projectile has a steel jacket 63 and a lead core 64. In the forward area of the body of the projectile, notches 65, saw tooth-like in cross section, are impressed in the steel jacket such that in flight, the air impacts the upstanding rear wall of said notches, and hinders the rotation of the projectile. Upon penetration of the projectile into the target, these notches increase the relative rotation of the projectile by deflecting material off the notches, as previously described, so that the projectile cannot tumble. The size and angular position of wall 66 is designed in relation to the longitudinal axis of the body of the projectile, so that while the projectile is adequately stable in flight within the target area desired, for example 300 to 400 meters, it loses stability thereafter and rapidly drops to the ground, thus eliminating any uncontrolled danger to areas behind the target.

The desirable range for pistol ammunition generally does not exceed 75 meters, so that the notches 55 are laid out for such a range.

While the projectile is preferably intended for hunting and sporting use, wherein danger to areas behind the target is especially undesirable, it may be designed and used in principle for all rifles, pistols or revolvers.

It should be understood that the individual characteristics of the above described embodiments of the projectiles according to the invention are mutually interchangeable. Care should be taken, however, that when a lead filler is used, it must not be exposed after the impact of the projectile on the target, in order to avoid contact with the mass of the target such as, for example, a wild animal.

I claim:

1. A projectile, comprising:

(a) a body having a tapered front end and a longitudinal axis, said body being formed with an opening extending from said front end along said longitudinal axis;

(b) a plurality of first generally longitudinal notches formed in spaced relationship in said body and extending from said forward end, said notches being inclined at an angle relative to said longitudinal axis and in a direction opposite to a direction of rotation of said projectile; and (c) a plurality of strips defined by the spaces between said notches, said strips being rolled back upon impact of said projectile on a target, said strips when rolled back each having a front surface lying in a plane forming an oblique angle with a plane perpendicular to said longitudinal axis, said front surfaces serving to enhance rotation of said projectile in said target upon impact.

2. The projectile of claim 1, said projectile further including insert means closing the front end of said opening.

3. The projectile of claim 2, wherein said opening includes a conical expansion at said forward end, and wherein said insert means includes a disk shaped insert.

4. The projectile of claim 3, wherein said disk shaped insert comprises a truncated cone having an outer surface matingly engageable with a surface of said conical expansion.

5. The projectile of claim 1, wherein said notches are formed in an outside surface of said body.

6. The projectile of claim 5, wherein said notches extend to said opening.

7. The projectile of claim 6, said projectile further including a plurality of second notches formed rearwardly of said first notches.

8. The projectile of claim 5, wherein said notches extend radially inward from said outer surface and toward but not reaching said opening.

9. The projectile of claim 8, said projectile further including a plurality of oblique cuts in said body extending radially outward from said opening.

10. The projectile of claim 1, wherein said notches are tapered in width, the greatest width of said notches being at said forward end.

11. The projectile of claim 1, wherein said strips are generally wedge shaped in configuration.

12. The projectile of claim 2, wherein said insert means fills said center opening and has a spherical outer surface at the front of said projectile.

13. The projectile of claim 12, wherein said body is further formed with a recess in its trailing end, and filler means in said recess.

14. The projectile of claim 2, wherein said central opening extends through said body, said insert means comprises a generally spherical insert of a comparatively soft material positioned in said outer end of said opening, and plate means closing the opposite end of said opening.

* * * * *